US007984544B2

(12) United States Patent
Rosenberg

(10) Patent No.: US 7,984,544 B2
(45) Date of Patent: Jul. 26, 2011

(54) METHOD FOR MANUFACTURING LONG FORCE SENSORS USING SCREEN PRINTING TECHNOLOGY

(75) Inventor: Ilya D. Rosenberg, Wayne, NJ (US)

(73) Assignees: Ilya D. Rosenberg, Wayne, NJ (US); Alexander Jaoshvili, Jersey City, NJ (US); Richard A. Brandt, New York, NY (US)

( * ) Notice: Subject to any disclaimer, the term of this patent is extended or adjusted under 35 U.S.C. 154(b) by 0 days.

(21) Appl. No.: 11/917,798

(22) PCT Filed: Jun. 16, 2006

(86) PCT No.: PCT/US2006/023578

§ 371 (c)(1),
(2), (4) Date: Jun. 27, 2008

(87) PCT Pub. No.: WO2006/138618

PCT Pub. Date: Dec. 28, 2006

(65) Prior Publication Data

US 2008/0314165 A1 Dec. 25, 2008

Related U.S. Application Data

(63) Continuation-in-part of application No. 11/154,004, filed on Jun. 16, 2005, now abandoned.

(51) Int. Cl.

| | |
|---|---|
| ***G01D 7/00*** | (2006.01) |
| ***G01L 1/04*** | (2006.01) |
| ***G01R 3/00*** | (2006.01) |

(52) U.S. Cl. ..... 29/595; 73/862.043; 73/862.621; 73/862.046; 29/831; 29/832

(58) Field of Classification Search ..... 73/862.043, 73/862.046, 862.68; 473/467; 338/114; 340/323 R; 29/595, 831, 832
See application file for complete search history.

(56) References Cited

U.S. PATENT DOCUMENTS

| | | | | |
|---|---|---|---|---|
| 3,774,194 | A | 11/1973 | Jokay et al. | |
| 3,982,759 | A | 9/1976 | Grant | |
| 3,987,259 | A * | 10/1976 | Larson | 200/5 A |
| 4,017,697 | A * | 4/1977 | Larson | 200/5 A |
| 4,062,008 | A | 12/1977 | Carlsson et al. | |

(Continued)

FOREIGN PATENT DOCUMENTS

WO WO 2004053908 A1 * 6/2004

*Primary Examiner* — Lisa M Caputo
*Assistant Examiner* — Jonathan Dunlap
(74) *Attorney, Agent, or Firm* — Schiff Hardin LLP

(57) ABSTRACT

A force or pressure sensor and appertaining method for manufacturing are provided in which the sensor comprises a repeating conductive trace pattern that can be replicated to produce a consistent conductive trace across more than one adjacent pattern section forming an electrical bus, wherein more than one section of a series of conductive traces are printed on a thin and flexible dielectric backing using the pattern. The thin and flexible dielectric backing has a repeated pattern of conductive traces printed above the dielectric backing and one or more dielectric layers provided above the conductive traces, the dielectric layers having access regions permitting contact of conductors above the one or more dielectric layers, and a sensor conductor layer printed above the one or more dielectric layers that contacts the conductive traces via at least one of the access regions or regions not covered by the one or more dielectric layers.

17 Claims, 15 Drawing Sheets

U.S. PATENT DOCUMENTS 4,092,634 A 5/1978 Von Kohorn
4,109,911 A 8/1978 Van Auken
4,357,531 A * 11/1982 Knight ..... 235/400
4,365,805 A 12/1982 Levine
4,375,289 A 3/1983 Schmall et al.
4,422,647 A 12/1983 Wilson et al.
4,479,392 A * 10/1984 Froeb et al. ..... 73/862.68
4,602,135 A * 7/1986 Phalen ..... 200/5 A
4,664,376 A 5/1987 Gray
4,744,863 A 5/1988 Guckel et al.
4,810,992 A * 3/1989 Eventoff ..... 338/99
4,840,377 A 6/1989 Bowser et al.
4,855,711 A 8/1989 Harrop et al.
4,859,986 A * 8/1989 Van Auken et al. ..... 473/467
4,990,897 A 2/1991 Beyma et al.
5,010,774 A * 4/1991 Kikuo et al. ..... 73/862.046
5,033,291 A 7/1991 Podoloff et al.
5,059,944 A 10/1991 Carmona
5,342,042 A 8/1994 Candy et al.
5,394,824 A * 3/1995 Johnson, Jr. ..... 116/203
5,431,064 A 7/1995 Franz
5,505,072 A 4/1996 Oreper
5,578,765 A * 11/1996 Franz ..... 73/862.043
5,583,303 A * 12/1996 Franz ..... 73/862.046
5,672,128 A 9/1997 Conn
5,756,904 A 5/1998 Oreper et al.
5,900,292 A 5/1999 Moriya
5,905,209 A 5/1999 Oreper
5,908,361 A 6/1999 Fisher et al.
5,954,599 A 9/1999 Lin
5,962,118 A * 10/1999 Burgess ..... 428/308.4
5,989,700 A 11/1999 Krivopal
6,032,542 A 3/2000 Warnick et al.
6,062,997 A 5/2000 Seymour
6,155,120 A * 12/2000 Taylor ..... 73/862.046
6,216,545 B1 * 4/2001 Taylor ..... 73/862.046
6,225,814 B1 5/2001 Oreper et al.
6,272,936 B1 8/2001 Oreper et al.
6,367,332 B1 4/2002 Fisher et al.
6,367,800 B1 4/2002 Sheck et al.
6,641,860 B1 11/2003 Kaiserman et al.
6,715,760 B2 4/2004 Miller
6,816,184 B1 11/2004 Brill et al.
6,964,205 B2 * 11/2005 Papakostas et al. ..... 73/862.046
7,059,203 B2 * 6/2006 Asai et al. ..... 73/862.046
7,113,179 B2 * 9/2006 Baker et al. ..... 345/178
7,213,323 B2 * 5/2007 Baker et al. ..... 29/595
7,224,257 B2 * 5/2007 Morikawa ..... 338/47
7,258,026 B2 * 8/2007 Papakostas et al. ..... 73/862.046
7,404,331 B2 * 7/2008 Ruud et al. ..... 73/722
7,543,510 B2 * 6/2009 Bieck et al. ..... 73/862
2002/0050173 A1 * 5/2002 Taguchi et al. ..... 73/753
2002/0104369 A1 * 8/2002 Baker et al. ..... 73/31.06
2005/0145045 A1 * 7/2005 Papakostas et al. ..... 73/864
2005/0268699 A1 * 12/2005 Papakostas et al. ..... 73/46
2007/0171058 A1 * 7/2007 Knowles et al. ..... 340/565
2008/0200285 A1 * 8/2008 Haseth ..... 473/422

* cited by examiner

METHOD FOR MANUFACTURING LONG FORCE SENSORS USING SCREEN PRINTING TECHNOLOGY

CROSS-REFERENCE TO RELATED APPLICATIONS

The present application is a national stage entry of PCT Application Number PCT/US06/23578, filed Jun. 16, 2006, which is a continuation-in-part of its priority application, U.S. patent application Ser. No. 11/154,004, filed Jun. 16, 2005, now abandoned herein incorporated by reference.

BACKGROUND

The present invention relates to a method for manufacturing long force sensors with a repeated design pattern using screen printing or other repetitive printing technology. Sensors produced according to the method do not have any practical limitation on length.

Such sensor technology is desirable in situations in which a lengthy sensor construction is needed. For example, in a tennis court, it is desirable to automate line calling, which is the detection as to whether a tennis ball impacts the ground at an in-bounds location or an out-of-bounds location. Flat force detecting sensors may be utilized at the boundaries to make a determination of the point of ball impact. An exemplary use of such sensors is described in the U.S. patent application Ser. No. 11/917,802, herein incorporated by reference.

Because of the tennis court size, sensors have to be manufactured extremely long (up to 60' long). In principle, one could simply create and utilize sensors having a length of, e.g., 3' or, and then arrange such sensors next to one another all the way along the various boundary lines. However, the sensors manufactured with various embodiments of the present inventive technology provide numerous advantages.

During the installation of such flat sensors, one cannot avoid overlapping the sensors in order to provide a sensing area all the way along the lines. This overlapping leads to surface unevenness. The primary reason for this is that along the perimeter of the sensor, there is typically an area which is not sensitive and which is devoted for adhesive or waterproofing. For short sensors, the overlaps become numerous.

Additionally, each sensor area requires a cable connecting it to a computer. Again, in a short sensor configuration and considering the size of a tennis court, use of short sensors would require a tremendous amount of cables running across the area, which would make the system very complex, unreliable, and very expensive, relative to a system in which long sensors are used.

SUMMARY

The present invention is directed to a method for manufacturing a force or pressure detecting sensor comprising: designing a repeating conductive trace pattern that can be replicated to produce a consistent conductive trace across more than one adjacent pattern section forming an electrical bus; and printing more than one section of a series of conductive traces on a thin and flexible dielectric backing using the pattern. The invention is also directed to a sensor comprising: a thin and flexible dielectric backing; a repeated pattern of conductive traces printed above the dielectric backing; one or more dielectric layers provided above the conductive traces, the dielectric layers having access regions permitting contact of conductors above the one or more dielectric layers; and a sensor conductor layer printed above the one or more dielectric layers that contacts the conductive traces via at least one of the access regions or regions not covered by the one or more dielectric layers.

It should be noted that sensors made as long as 60' still require one to address the effect of thermal expansion and contraction, because of the difference in the coefficients of thermal expansion for plastic (as a part of the sensor) and asphalt or concrete (on or within which the sensor resides). In order to prevent bubbling and separation of the sensor from the ground, one may use a double sided adhesive, contact cement, epoxy or other adhesion means which forms a sufficiently strong bond. Examples could include VHB tape or Dp190 and Dp460 epoxies made by 3M.

The obvious advantage of printing a multi-layer sensor is that conductive traces do not take up space on the side which minimizes the dead area of the sensor dramatically. For example, if one tried to print a 40' long sensor and run conductive traces on the sides on an 18" wide strip of Mylar plastic, the actual sensor width would be reduced to 12" (30% loss of the area). One could try to reduce the width and separation between the traces, but that would lead to unacceptable increase in resistance, as well as to errors due to screen printing technology tolerance.

DESCRIPTION OF THE DRAWINGS

The invention is best understood with reference to the drawings illustrating various embodiments of the sensor manufacture. Although all of the following diagrams are pictorial in nature, it is not necessary that these diagrams reflect an accurate dimensional scaling.

Figure 1:
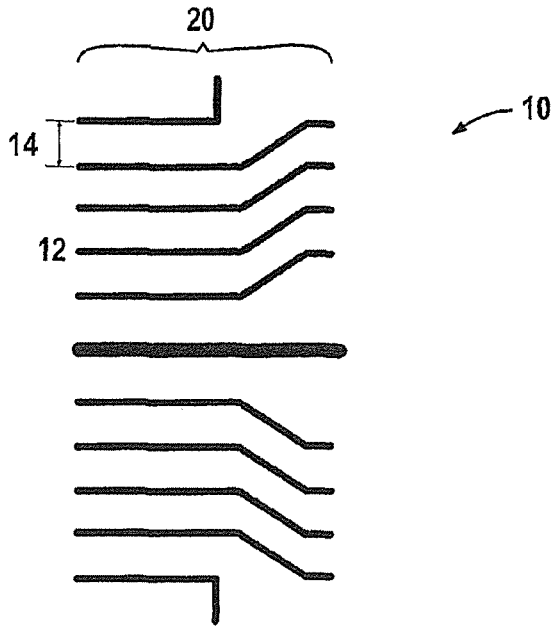
FIG. 1 is a pictorial drawing illustrating a sensor segment or section.

The following Figures are duplicative of the previously described figures but are shown without reference characters and more to scale for purposes of clarity.

Figure 2:
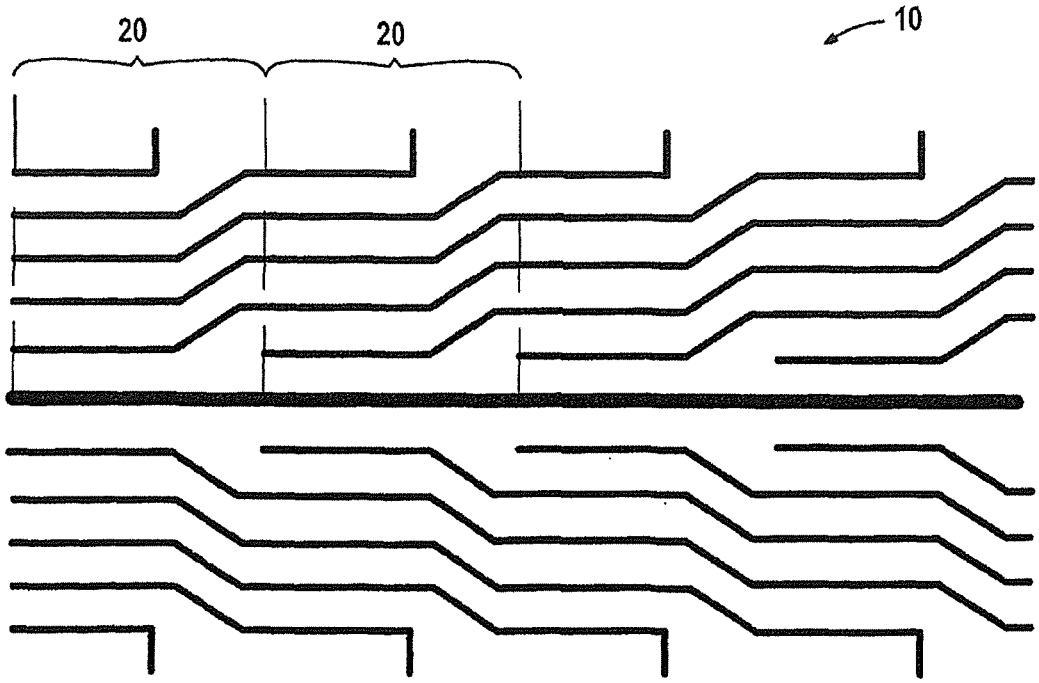
FIG. 2 is a pictorial drawing illustrating the repeated pattern of the sensor segment.
Figure 4:
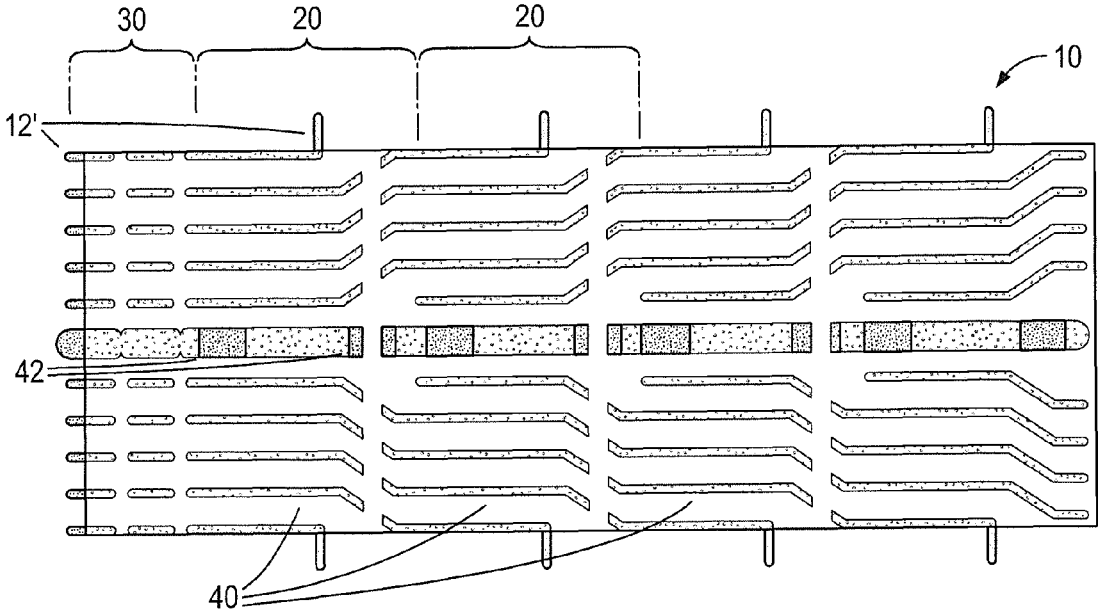
FIG. 4 is a pictorial drawing of that which is shown in FIG. 3 and having at least one dielectric layers.
Figure 5:
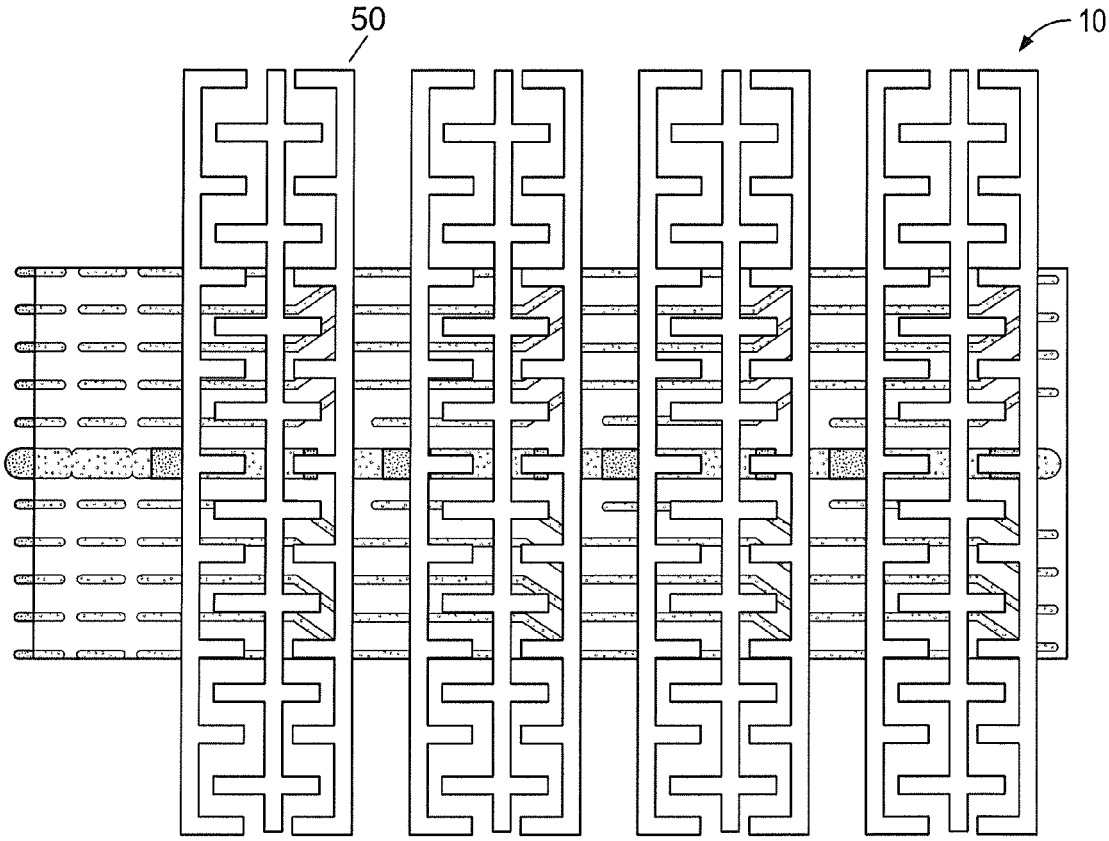
FIG. 5 is a pictorial diagram of that which is shown in FIG. 4 shows interdigitated conductors that are placed in a top layer.
Figure 6:
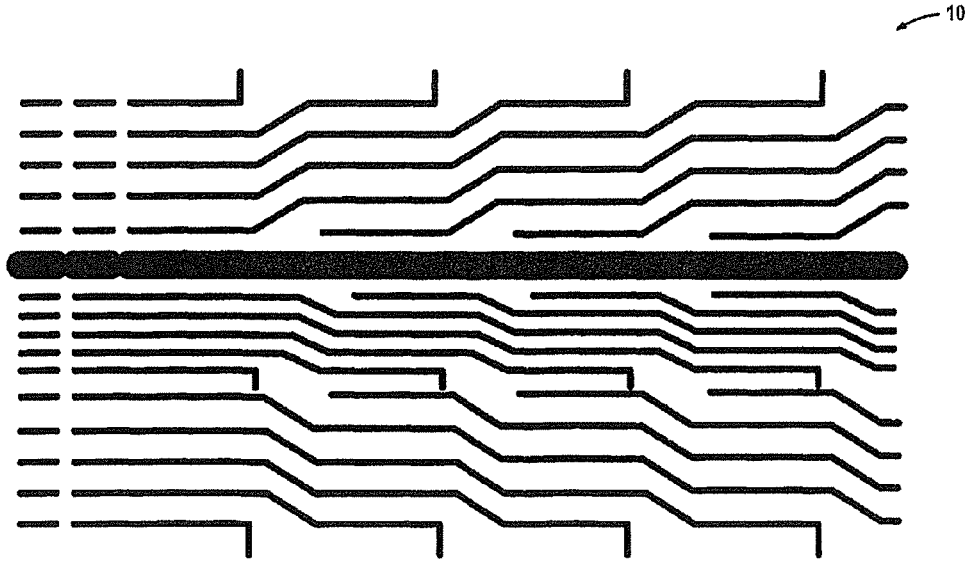
FIG. 6 is a pictorial drawing showing an alternative embodiment of that shown in FIG. 2, which is suited for, e.g., a center line sensor.
Figure 11:
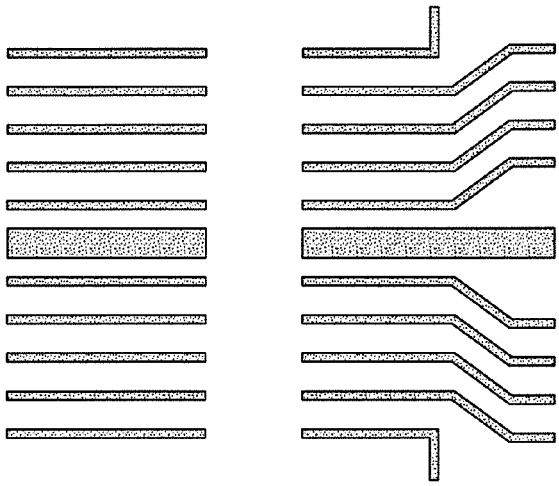
Figure 12:
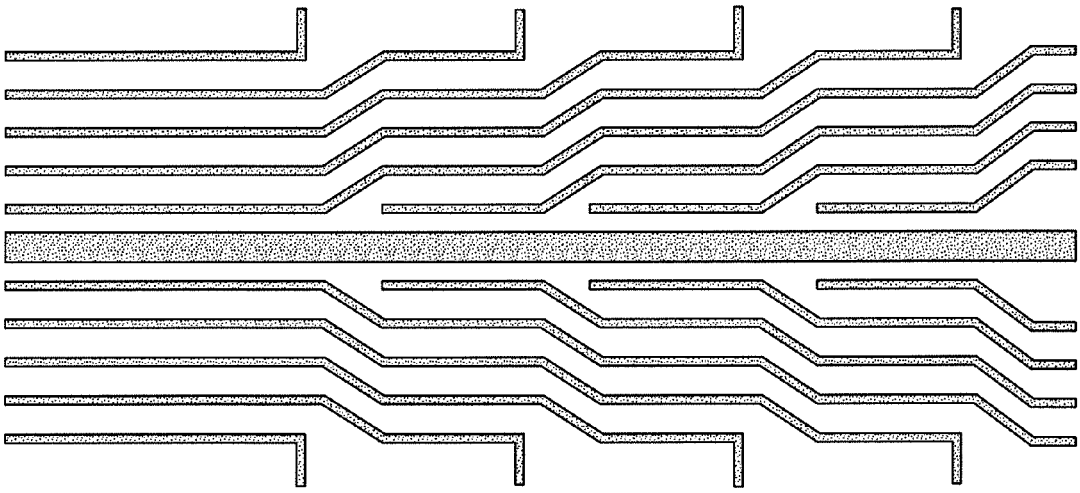
Figure 13:
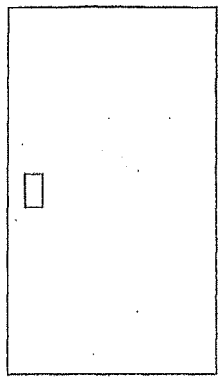
Figure 14:
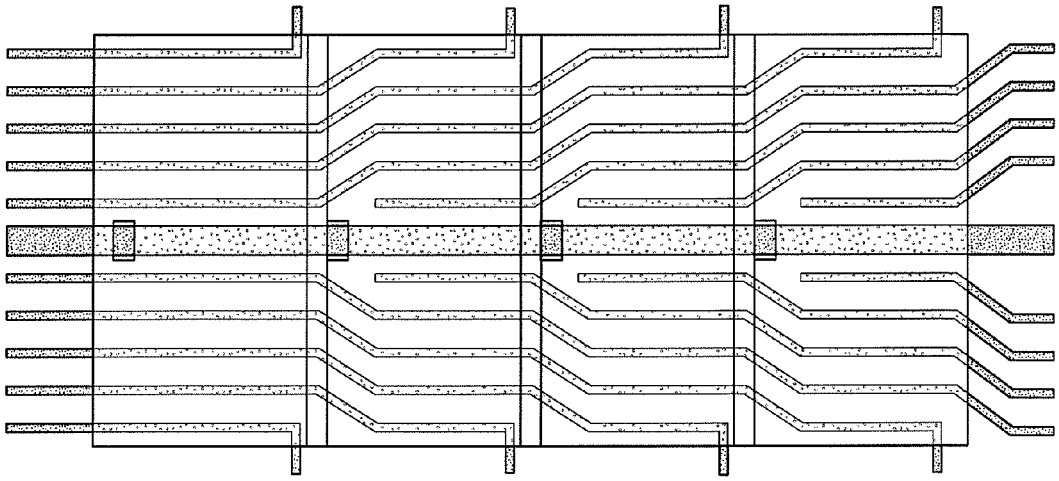
Figure 15:
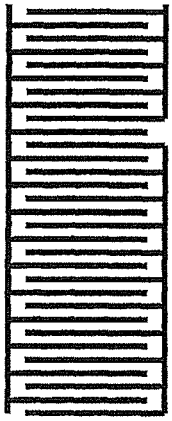
Figure 16:
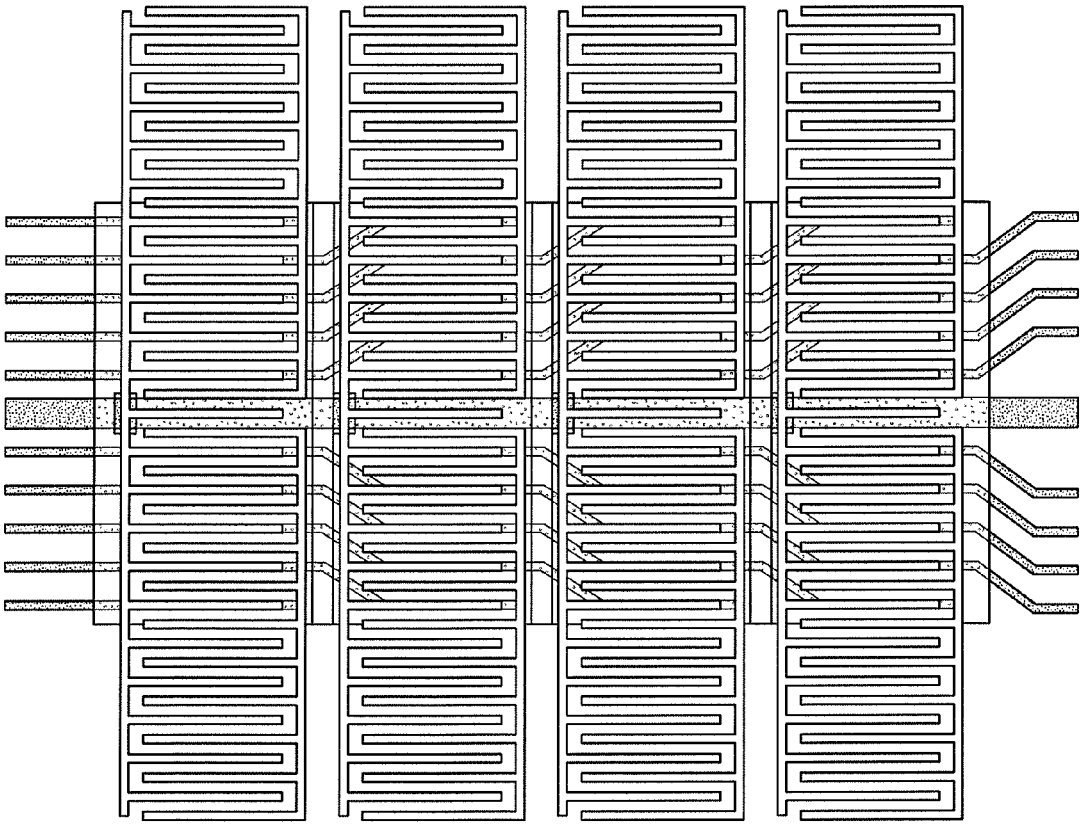
Figure 17:
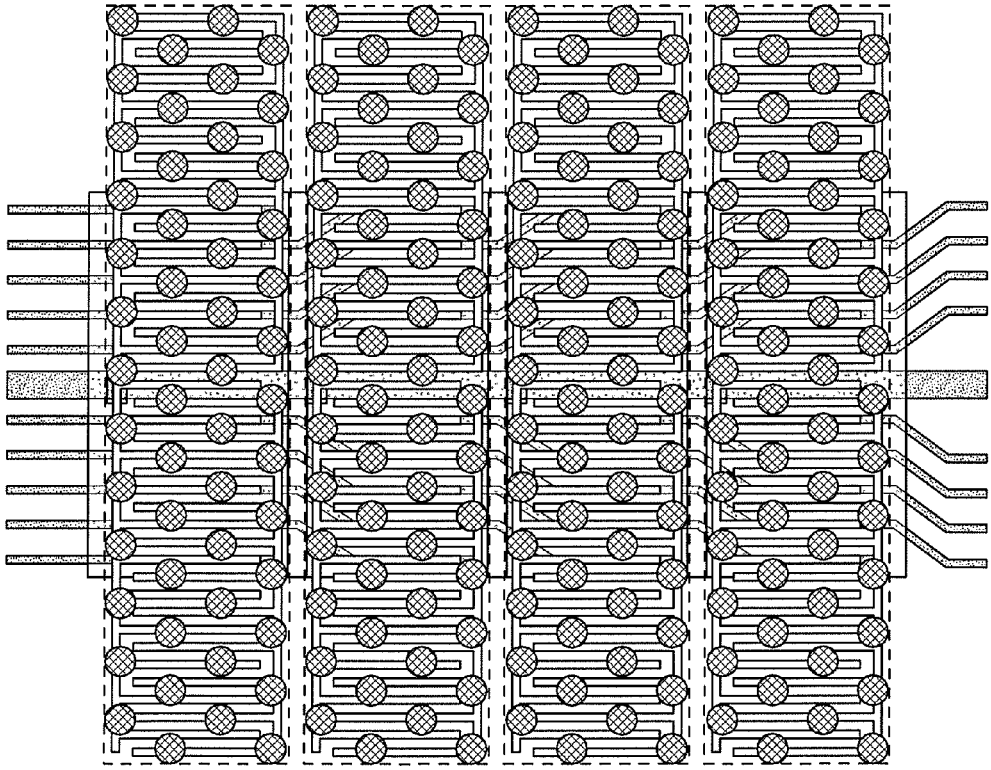
Figure 18:
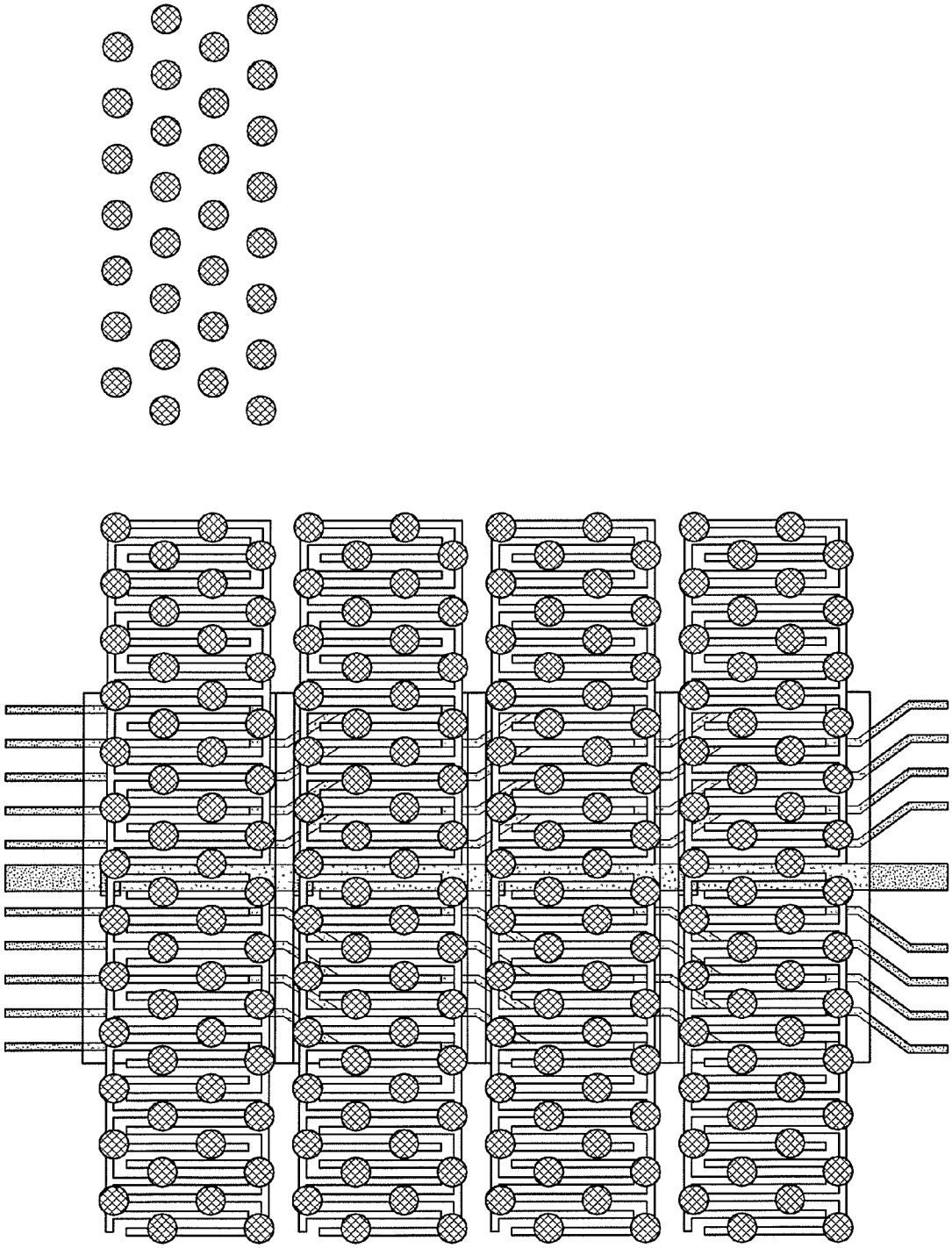
Figure 19:
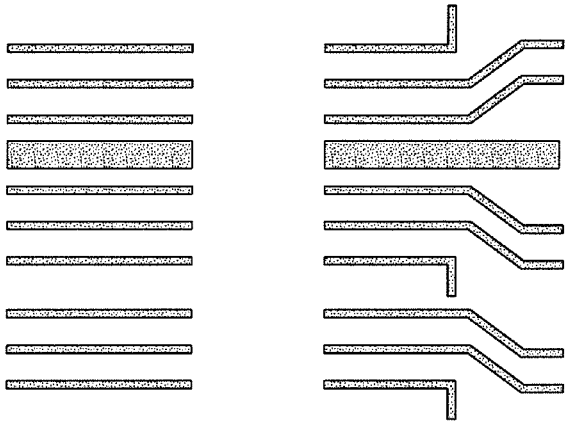
Figure 20:
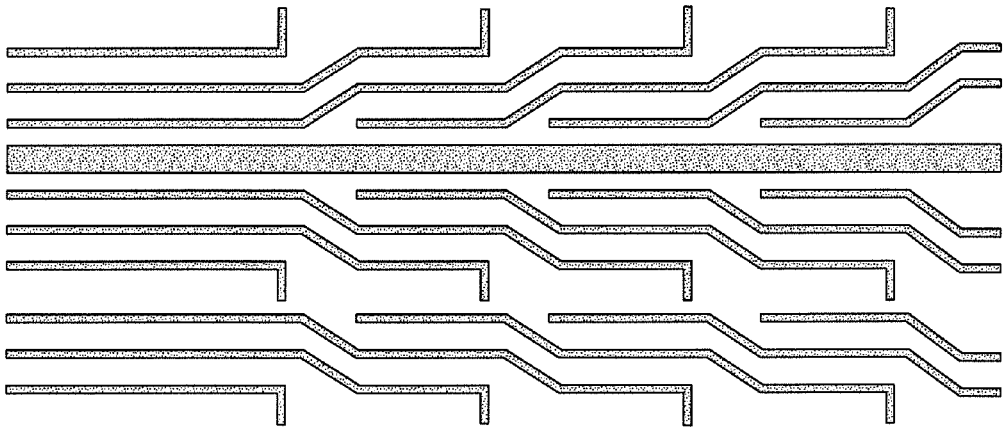
Figure 21:
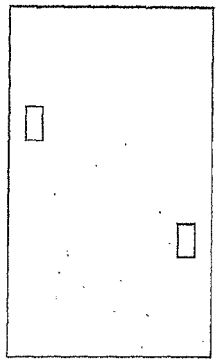
Figure 22:
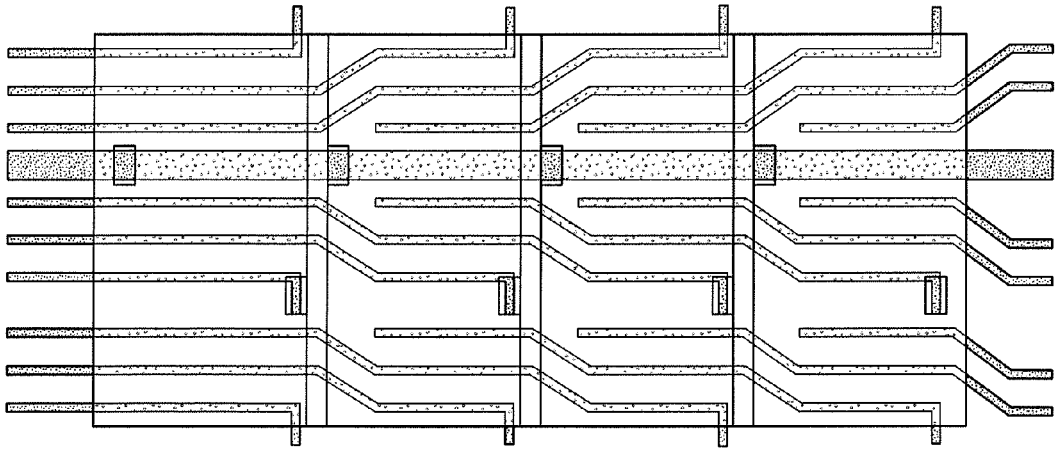
Figure 23:
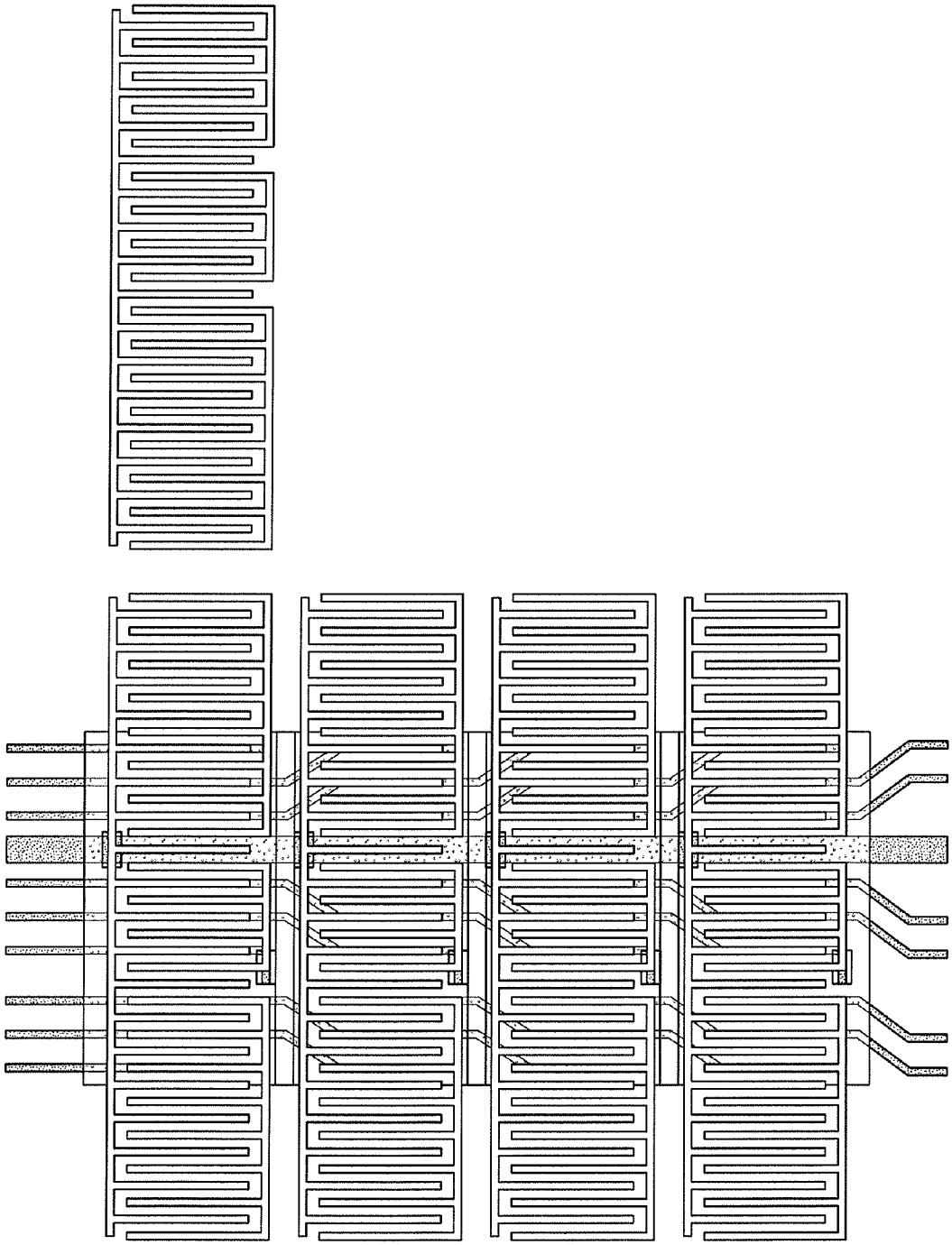
Figure 24:
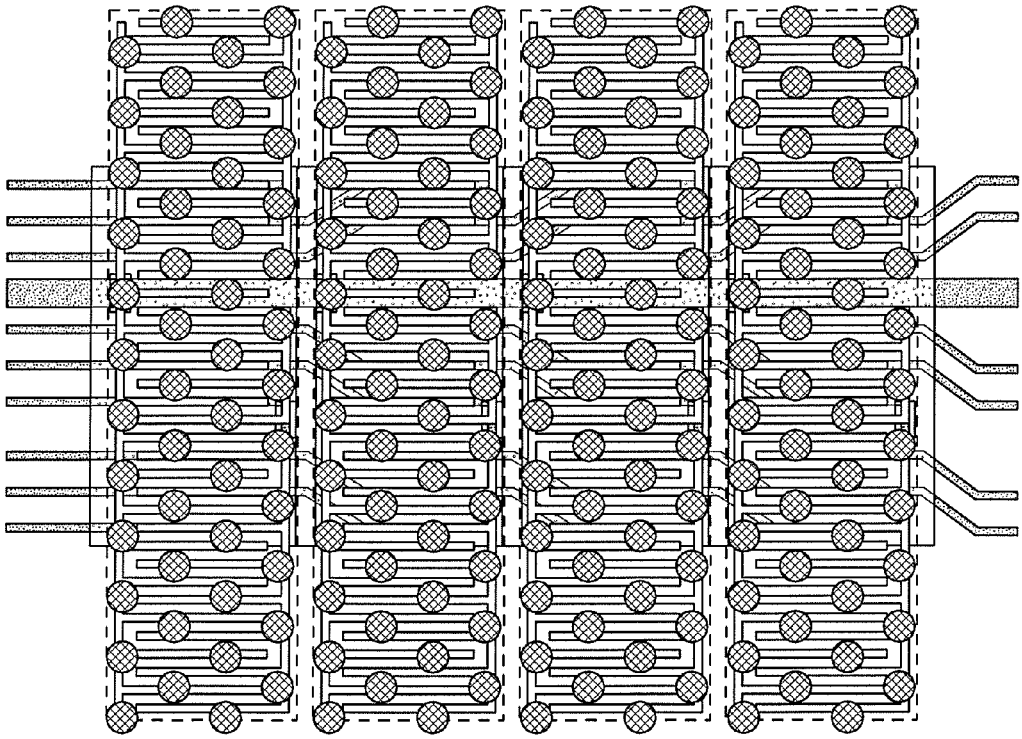
Figure 25:
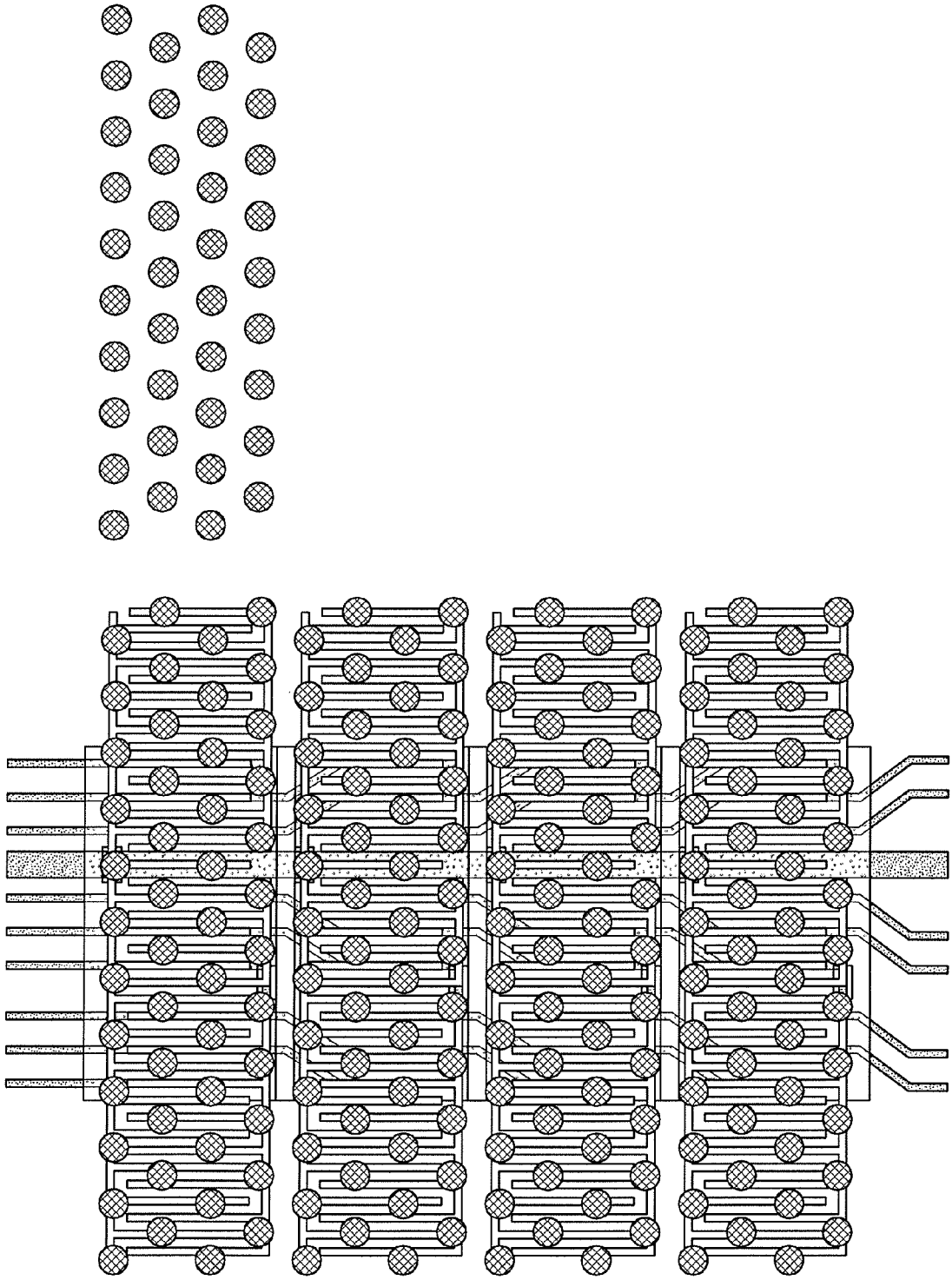

FIGS. 11 & 12 correspond to FIGS. 1 & 2 respectively;

FIG. 13 is a pictorial diagram illustrating one of the overlay layers;

FIG. 14 corresponds to FIG. 4;

FIG. 15 illustrates an exemplary pattern of the interdigitated conductors;

FIG. 16 corresponds to FIG. 5;

FIG. 17 illustrates an exemplary embodiment with all of the layers combined;

FIG. 18 is similar to FIG. 17 and shows the dot pattern for the adhesive;

FIGS. 19 & 20 correspond to the embodiment illustrated in FIG. 6;

FIG. 21 is a pictorial diagram showing an exemplary overlay for the embodiment of FIGS. 6, 19 and 20;

FIG. 22 is a pictorial diagram illustrating the embodiment of FIGS. 6, 19 and 20 with the overlay applied;

FIG. 23 illustrates the interdigitated conductors used on the embodiment of FIG. 22;

FIG. 24 illustrates all layers combined for the embodiment of FIGS. 6 and 19-23; and, FIG. 25 is similar to FIG. 24 and shows the dot pattern for the adhesive.

DETAILED DESCRIPTION OF THE PREFERRED EMBODIMENTS

As illustrated in FIG. 1, each sensor 10 comprises sections 20 that are fairly short in length and thus easy to print in a repetitive manner; such a length, for example, may be 1'. Each sensor section 20 may comprise a separate analog output. Separate sensor areas permit one to distinguish between different force or pressure events (for example, a ball impact and foot step) that can happen at the same time on separate areas of one particular sensor. They also allow one to localize the location of an event to within the area of a sensor, and in case of failure of a sensor area, only one small area would be affected. This idea of splitting up a sensor into smaller sensor areas is described in U.S. Pat. No. 3,982,759 (Grant).

Because of the desired length of the long sensors 10, they can only be printed if the artwork or layout design has a repeating pattern. The following discussion and references to the Figures illustrate how this is done.

First, a series of conductive traces 12 are printed on a thin and flexible dielectric backing. Given the excellent conductivity characteristics of silver, its use would be beneficial in the present design, although other known conductive materials may be used. Mylar plastic is an ideal dielectric backing that has the desired characteristics of being thin and flexible.

The pattern for the conductive traces may utilize a trace width of approximately 50 mils, with an appertaining separation 14 between the traces being approximately 50 mils as well. Of course, the widths and distances can easily be modified by one of skill in the art to values that are suitable for any particular application. The values chosen can depend on a length of the sensor, a number of wires to be printed, as well as on a size of a printing screen. An exemplary screen pattern is shown in FIGS. 2 and 6. It can be seen that the pattern consists of a continuous common trace which is thicker than the other traces 12. This common trace is shared by all of the sensor areas on a sensor. Additionally, one trace 12 is printed for each sensor area on the sensor. These traces take one step up or down after each print, forming a cascading pattern. This pattern is printed repetitively until the required length is achieved. Because the traces cascade, each sensor area ends up being connected to just one trace on the bus (discounting the common trace).

The printed trace section 20 is printed in a repeated manner, as illustrated in FIG. 2. It can be seen that repeating the patter shown in FIG. 1 permits a conductive trace pattern to span more than one printed section 20. Such a pattern can be repeatedly printed to a desired length, limited only by the amount of raw materials available.

Figure 3:
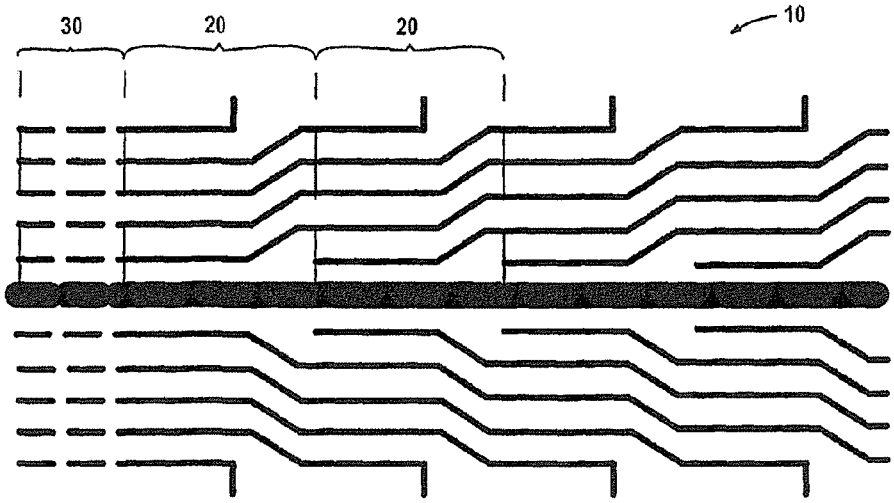
FIG. 3 is a pictorial drawing of that which is shown in FIG. 2, with the addition of a printed tail.

FIG. 3 illustrates the next step, in which a tail 30 is printed to the left which connects the sensors with cables from various electronics and/or computer systems used to acquire sensor readings. (Note that tail is printed on the same plastic as the sensor, therefore there is no connection point at an installation surface, such as the playing area of the tennis court).

As can be seen in FIG. 4, once the conductive traces 12 are printed, they are covered with one or more layers of a dielectric 40. Each print of the dielectric layer may have vias 42, which are holes that allow traces below 12 to interconnect with traces that are printed above 50 in the following step. Also, the dielectric layer does not cover tips from the bus, on top of which the final layer of conductive print will be applied. These tips also interconnect with traces that are printed above 50 in the following step. By way of these interconnections, the next layer printed 50 which is the layer that does the sensing, is electrically connected to appropriate traces 12 on the bus.

FIG. 5 illustrates the final layer that is applied on top of the dielectric layer 40, and comprises interdigitated fingers 50 that are used to contact portions of the conductive traces 12 lying below. This interdigitated finger 50 technique is a standard technique which is well known in the art and is described in U.S. Pat. No. 4,314,227 (Eventoff).

The sensor layout illustrated in FIGS. 1-5 is ideally designed and suited for detecting whether a tennis ball impact with the ground occurred "in" or "out" of a particular boundary line in which such sensors 10 have been placed, i.e., on the sidelines, baseline, and service lines of a tennis court.

In an embodiment of the sensor illustrated in FIGS. 6 and 20, it can be seen that an asymmetrical pattern (with regards to a longitudinal dividing line) is provided. Such a pattern may be utilized in, e.g., a center line of a tennis court for detecting whether a tennis ball landed to the left, right, or directly under the center line between two service courts.

The ideal pattern illustrated in the following figures is different due to the fact that players change the direction of the serve after each point. Thus, the sensor needs to have three positions with respect to the boundary line between two service courts, the position to the left, right, and directly under the center line between two service courts. The position directly under the center line always registers an IN bounce while the other two positions can register either OUT or IN depending on the direction of serve. The asymmetry of the trace pattern for the three position sensor is due to the fact that three sets of trace and a common trace need to be run to the three sets of sensor sections.

Figure 7:
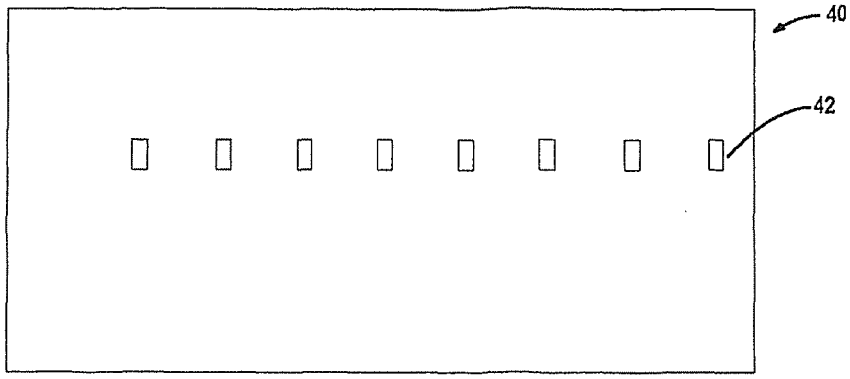
FIG. 7 is a pictorial diagram of a dielectric layer as used for the embodiment illustrated in FIG. 6.

FIG. 6 illustrates the sensor 10 layout pattern according to this embodiment in which conductive traces are asymmetrically provided around a horizontal longitudinal line. FIGS. 7 and 21 illustrate the appertaining dielectric 40 layer pattern that is utilized, including the holes 42. The hole 42 placement allows each of the three sensor sections to electrically connect with an appropriate trace from each of the three sets of traces.

Figure 8:
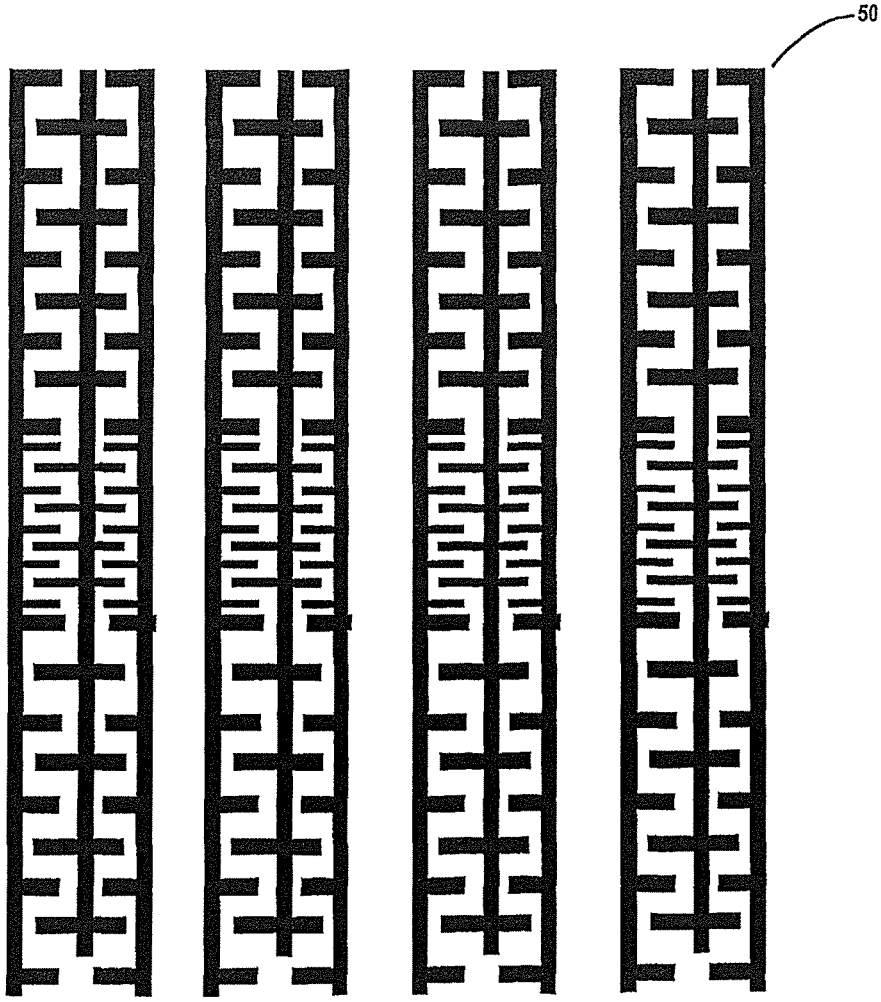
FIG. 8 is a pictorial diagram of the interdigitated conductive finger layer that may be used with the embodiment shown in FIGS. 6 and 7.

FIGS. 8 and 23 illustrate the interdigitating finger pattern 50 that is utilized in the sensor 10 of this embodiment.

Figure 9:
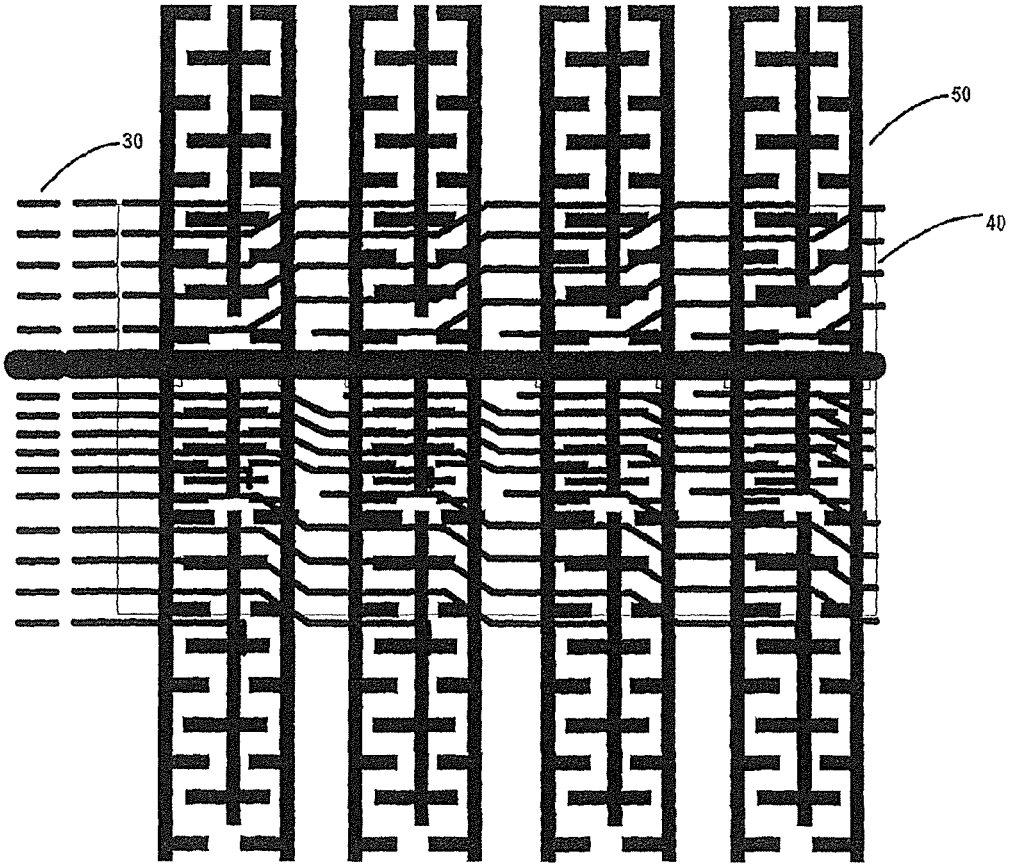
FIG. 9 is a pictorial diagram showing the combined elements illustrated in FIGS. 6-9.

Finally, FIG. 9 illustrates all of the layers of this second embodiment combined, after they are applied in sequence, as described above.

Figure 10:
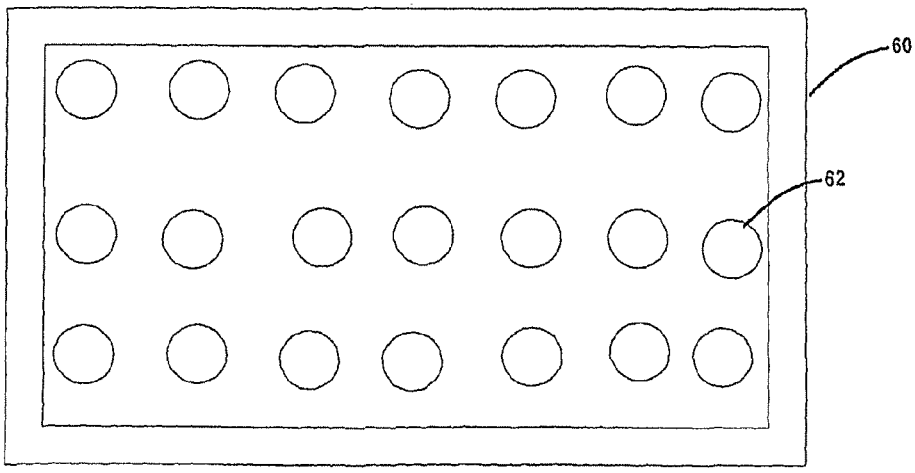
FIG. 10 is a pictorial diagram illustrating a layer comprising dielectric dots with adhesive on top.

FIG. 10 illustrates a printing of dielectric dots 62 on top of the interdigitating finger layer 50 with an adhesive on top, as well as, for example, 0.5" 3M VHB (very high bond double sided tape) 60 across the perimeter of the plastic. On top of the dot pattern, a top layer of plastic is typically attached which has an FSR layer that faces the interdigitating fingers 10. The FSR layer conducts electricity in a manner approximately proportionally to the force that is used to compress the top and bottom layer of the sensor together. In such a way, a long force or pressure sensor can be created. The dot pattern serves both to adhere the bottom and top layer together and to separate them so they do not touch when no force at all is applied. The tape serves to further reinforce the attachment between the top and bottom layers. Although a dot pattern is shown and a particular exemplary tape type described, one of skill in the art would recognize that the pattern could be varied and a perimeter adhesive of any workable type could be employed.

Because an assembled sensor can be damaged by excessive bending, it is advantageous to ship the top and bottom layer rolled up separately on spools to an installation site and to attach them together on site. Assembly of the top and bottom layer can be done easily by running the two layers simultaneously through a device such as a laminator. The laminator can be run in this way without laminating film, in which case the top and bottom layers would simply be joined together. However, by applying laminating film at the same time as the sensors are run through the laminator, the sensors can be hermetically sealed and waterproofed all in the same step. Furthermore, the lamination, helps in keeping dust out of the sensor, and further increasing the attachment strength between the top and bottom layers.

The printing of the adhesive on top of the dots as well as attaching VHB strips along the perimeter is optional and depends on the application of the sensor 10. In case the sensors 10 are to be used indoors, for example under Teraflex carpet made by Gerflor, one can avoid permanent attachment of the top layer and the bottom layer using adhesive but instead could laminate top and bottom with a laminating film that would keep dust out but also could be peeled off easily, as needed, to create a portable sensor 10 that can be rolled and re-used at different location or later on at the same location.

For example, some businesses use indoor facilities for hockey in the winter time and for tennis in the summer time. Therefore these businesses should be able to remove the sensors 10 from the courts after the tennis season is over, and install them back for the next season. When the sensors 10 are permanently assembled (using the adhesive and VHB, as described above) they can not be rolled or folded since that would lead to plastic distortion, and delamination, thereby damaging the sensors 10. Because the sensors 10 are extremely long, without the ability to separate the top and bottom and roll them, it would be problematic and expensive to store them over the winter period, or to transport them from one location to the other.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The present invention may be described in terms of functional block components and various processing steps. Such functional blocks may be realized by any number of hardware components configured to perform the specified functions. The particular implementations shown and described herein are illustrative examples of the invention and are not intended to otherwise limit the scope of the invention in any way. For the sake of brevity, conventional aspects may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A method for manufacturing a force or pressure detecting sensor comprising:

printing a first section of conductive traces on a thin and flexible dielectric backing using a pattern, wherein the pattern comprises a linear segment having an end connected to an end of a linear step;

printing a second section of conductive traces on the thin and flexible dielectric backing using the pattern; and, printing a third section of conductive traces on the thin and flexible dielectric backing using the pattern such that the conductive traces of the first, second, and third sections are coupled successively together to form an electrical bus having a repeating consistent cascading pattern.

2. The method according to claim 1, wherein the conductive traces comprise first conductive traces, the method further comprising:

printing a pattern of second conductive traces over the first conductive traces to connect to the first conductive traces upon application of a force or pressure.

3. The method according to claim 2, wherein the pattern of second conductive traces printed over the first conductive traces comprises interdigitating fingers.

4. The method according to claim 1, further comprising:

covering a portion of the electrical bus with a dielectric layer, wherein the dielectric layer comprises holes that expose portions of the conductive traces in order to allow electrical contact of conductors on a layer above the dielectric layer with appropriate traces below the dielectric layer upon application of a force or pressure.

5. The method according to claim 4, further comprising:

printing the conductors on a conductor layer above the dielectric layer in an overlay sensor pattern.

6. The method according to claim 5 where the overlay pattern is that of a sensor pattern comprising interdigitating fingers.

7. The method according to claim 5, further comprising assembling at least two of the layers on an installation site with a laminator.

8. The method according to claim 1, further comprising:

creating a conductive tail on the flexible dielectric backing at one end of the first, second, and third sections that connects the electrical bus with electronic interface cables.

9. The method according to claim 1, further comprising printing an adhesive layer in a pattern on an exterior surface.

10. The method according to claim 9, wherein the adhesive pattern comprises dots.

11. The method according to claim 9, wherein the adhesive layer comprises double sided adhesive, contact cement, or epoxy.

12. The method according to claim 9, further comprising attaching VHB strips along a perimeter of the sensor.

13. The method according to claim 1, further comprising adding a laminating film to a top and bottom surface of the sensor.

14. The method according to claim 1, wherein the conductive traces are made of silver.

15. The method according to claim 1, wherein the dielectric backing is Mylar.

16. The method according to claim 1, wherein a width of the conductive traces=50 mils.

17. The method according to claim 1, wherein a separation of the conductive traces is 50 mils.

* * * * *